US010849481B2

(12) United States Patent
Hofmann et al.

(10) Patent No.: US 10,849,481 B2
(45) Date of Patent: Dec. 1, 2020

(54) DRYING SYSTEMS FOR DISHWASHER APPLIANCES

(71) Applicant: Haier US Appliance Solutions, Inc., Wilmington, DE (US)

(72) Inventors: Adam Christopher Hofmann, Louisville, KY (US); Matthew David Mersch, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 326 days.

(21) Appl. No.: 15/450,158

(22) Filed: Mar. 6, 2017

(65) Prior Publication Data

US 2018/0249884 A1 Sep. 6, 2018

(51) Int. Cl.
*A47L 15/48* (2006.01)
*A47L 15/42* (2006.01)

(52) U.S. Cl.
CPC ..... *A47L 15/488* (2013.01); *A47L 15/4246* (2013.01); *A47L 15/486* (2013.01)

(58) Field of Classification Search
CPC .... A47L 15/483; A47L 15/486; A47L 15/488; A47L 15/4291
See application file for complete search history.

(56) References Cited

U.S. PATENT DOCUMENTS 5,337,500 A * 8/1994 Enokizono ..... A47L 15/486 34/225
7,767,029 B2 * 8/2010 Lee ..... A47L 15/0034 134/56 D
7,798,157 B2 * 9/2010 Kim ..... A47L 15/486 134/107
8,875,721 B2 * 11/2014 Bertsch ..... A47L 15/0013 134/105
9,045,854 B2 * 6/2015 Clark ..... D06F 58/02
9,574,804 B2 * 2/2017 Dreossi ..... D06F 58/206
2016/0022115 A1 1/2016 Vallejo Noriega
2016/0106298 A1 4/2016 Kan et al.

FOREIGN PATENT DOCUMENTS

WO WO2014/180648 A1 11/2014

* cited by examiner

*Primary Examiner* — David J Laux
(74) *Attorney, Agent, or Firm* — Dority & Manning, P.A.

(57) ABSTRACT

A dishwasher appliance is provided. The dishwasher appliance includes a cabinet and a tub positioned within the cabinet. The tub may define a wash chamber. The dishwasher appliance may also include a drying system comprising a cooling conduit, a first fan, and a second fan. The cooling conduit may define a cooling conduit passage that is in fluid communication with the wash chamber. The first fan may be operable to draw wash chamber air into the cooling conduit passage. In addition, the second fan may be operable to direct a flow of ambient air onto an exterior surface of the cooling conduit.

10 Claims, 8 Drawing Sheets

DRYING SYSTEMS FOR DISHWASHER APPLIANCES

FIELD OF THE INVENTION

The present disclosure relates generally to dishwasher appliances. In particular, the present disclosure relates to drying systems for dishwasher appliances.

BACKGROUND OF THE INVENTION

Dishwasher appliances may execute wash and rinse cycles to clean dishes and other items. In this respect, dishwasher appliances generally include a tub that defines a wash chamber. The dishes and other items may be placed on rack assemblies positioned within the wash chamber. During the wash and rinse cycles, spray arms within the wash chamber may apply or direct a wash fluid (e.g., various combinations of water, detergent, and/or additives) onto dishes and other items on the rack assemblies. Upon completion of the wash and rinse cycles, the air within the wash chamber generally includes a high water content (i.e., the wash chamber air is humid).

After completion of the wash and rinse cycles, dishwasher appliances generally commence a dry cycle in which the dishes and other items within the wash chamber are dried. During the drying cycle, the dishwasher appliances remove moisture (e.g., water) from the wash chamber air. For example, some dishwasher appliances include drying systems that exhaust the hot and humid wash chamber air directly into the ambient air. As the ambient air cools the wash chamber air, condensation may form on the floor and other nearby surfaces. Other dishwasher appliances use drying systems that mix ambient air with low moisture content with the air in the wash chamber to reduce the relative humidity thereof. This, however, may result in increased drying time.

Accordingly, a dishwasher appliance having an improved drying system would be useful.

BRIEF DESCRIPTION OF THE INVENTION

Aspects and advantages of the invention will be set forth in part in the following description, or may be obvious from the description, or may be learned through practice of the invention.

In one embodiment, a dishwasher appliance defining a vertical direction is provided. The dishwasher appliance may include a cabinet and a tub positioned within the cabinet. The tub may define a wash chamber. The dishwasher appliance may also include a drying system comprising a cooling conduit, a first fan, and a second fan. The cooling conduit may define a cooling conduit passage that is in fluid communication with the wash chamber. The first fan may be operable to draw wash chamber air into the cooling conduit passage. In addition, the second fan may be operable to direct a flow of ambient air onto an exterior surface of the cooling conduit.

In another embodiment, a dishwasher appliance defining a vertical direction is provided. The dishwasher appliance may include a cabinet and a tub positioned within the cabinet. The tub may define a wash chamber. The dishwasher appliance may also include a drying system comprising a cooling conduit, a first fan, and a second fan. The cooling conduit may define a cooling conduit passage that is in fluid communication with the wash chamber. The first fan may be operable to draw wash chamber air into the cooling conduit passage, whereas the second fan may be operable to direct a flow of ambient air onto an exterior surface of the cooling conduit. In addition, the wash chamber air within the cooling conduit may be fluidly isolated from the follow of ambient air during operation of the dishwasher appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
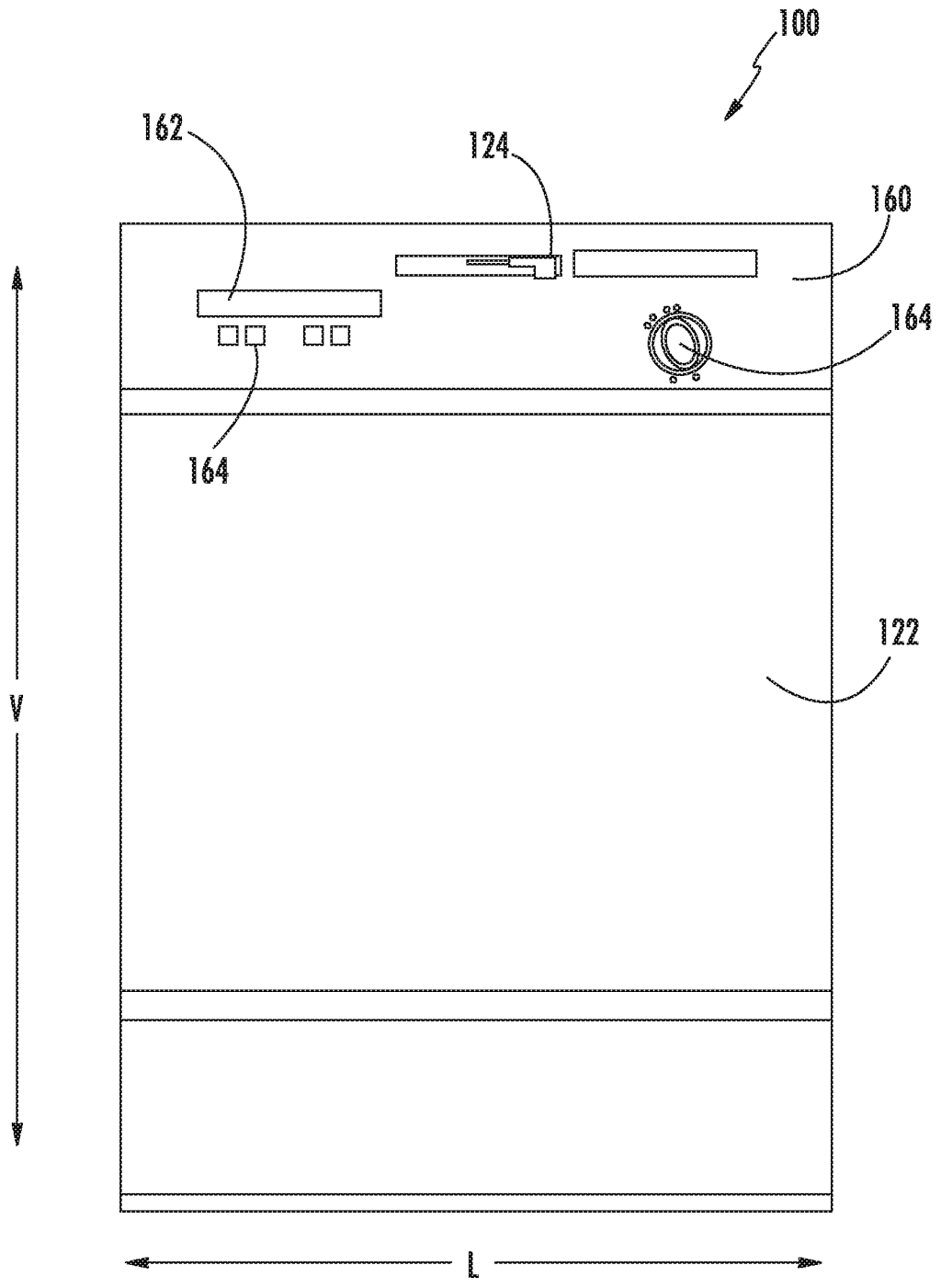
FIG. 1 provides a front view of a dishwasher appliance in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment may be used with another embodiment to yield a still further embodiment. Thus, it is intended that the present invention covers such modifications and variations as come within the scope of the appended claims and their equivalents.

As used herein, the term "article" may refer to but need not be limited to dishes, pots, pans, silverware, and other cooking utensils and items that may be cleaned in a dishwashing appliance. The term "wash cycle" is intended to refer to one or more periods of time during which a dishwasher appliance operates while containing the articles to be washed and uses a detergent and water, preferably with agitation, to e.g., remove soil particles including food and other undesirable elements from the articles. The term "rinse cycle" is intended to refer to one or more periods of time in which the dishwashing appliance operates to remove residual soil, detergents, and other undesirable elements retained by the articles after completion of the wash cycle. The term "wash fluid" refers to a liquid used for washing and/or rinsing the articles and is typically made up of water and may include other additives such as detergent or other treatments.

Figure 2:
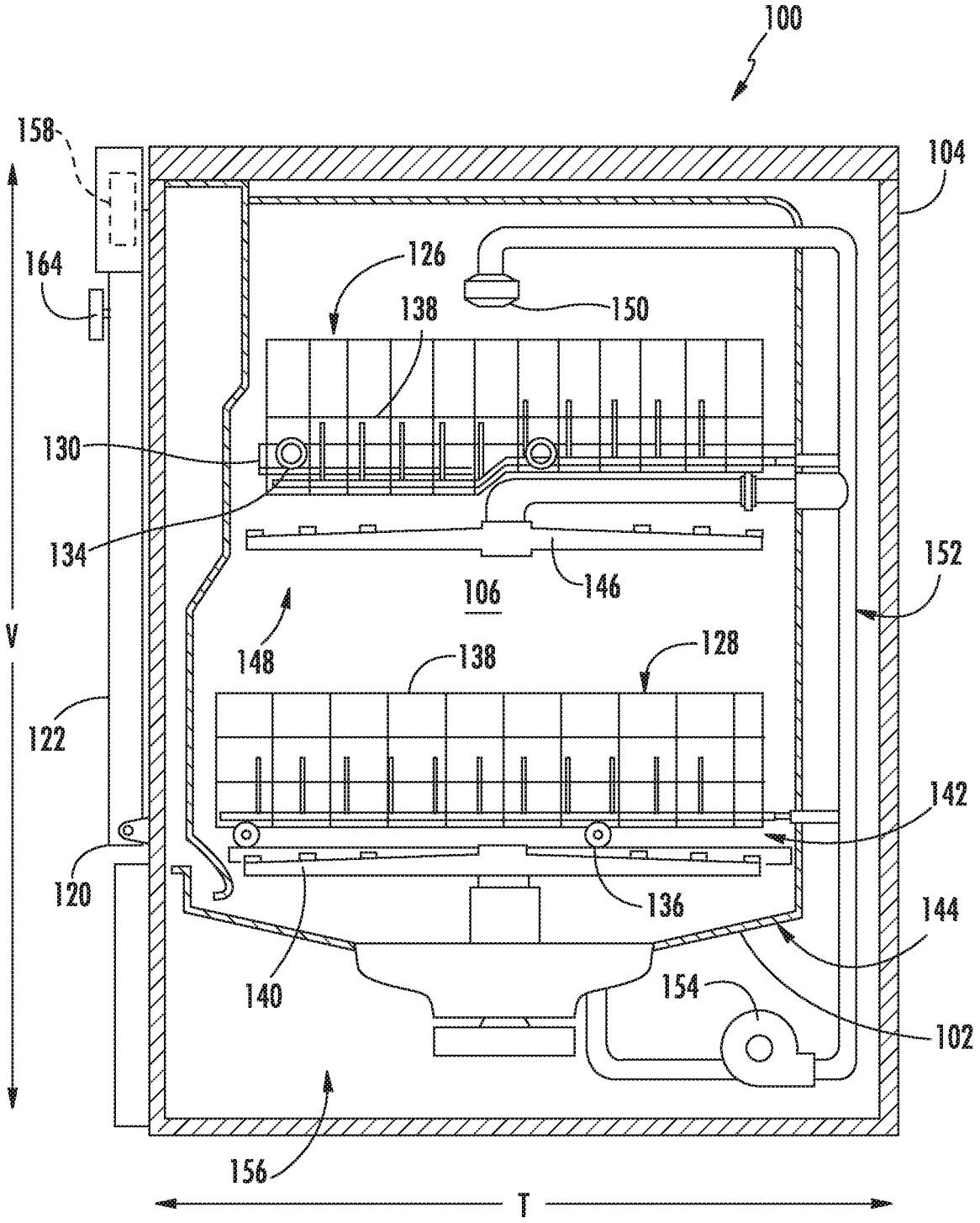
FIG. 2 provides a side cross-sectional view of a dishwasher appliance in accordance with embodiments of the present disclosure.

FIGS. 1 and 2 depict a dishwasher appliance 100 that may be configured in accordance with aspects of the present disclosure. As shown, the dishwasher appliance 100 defines a lateral direction L, a transverse direction T, and a vertical direction V. In general, lateral, transverse, and vertical directions L, T, V are mutually perpendicular to one another.

Figure 3:
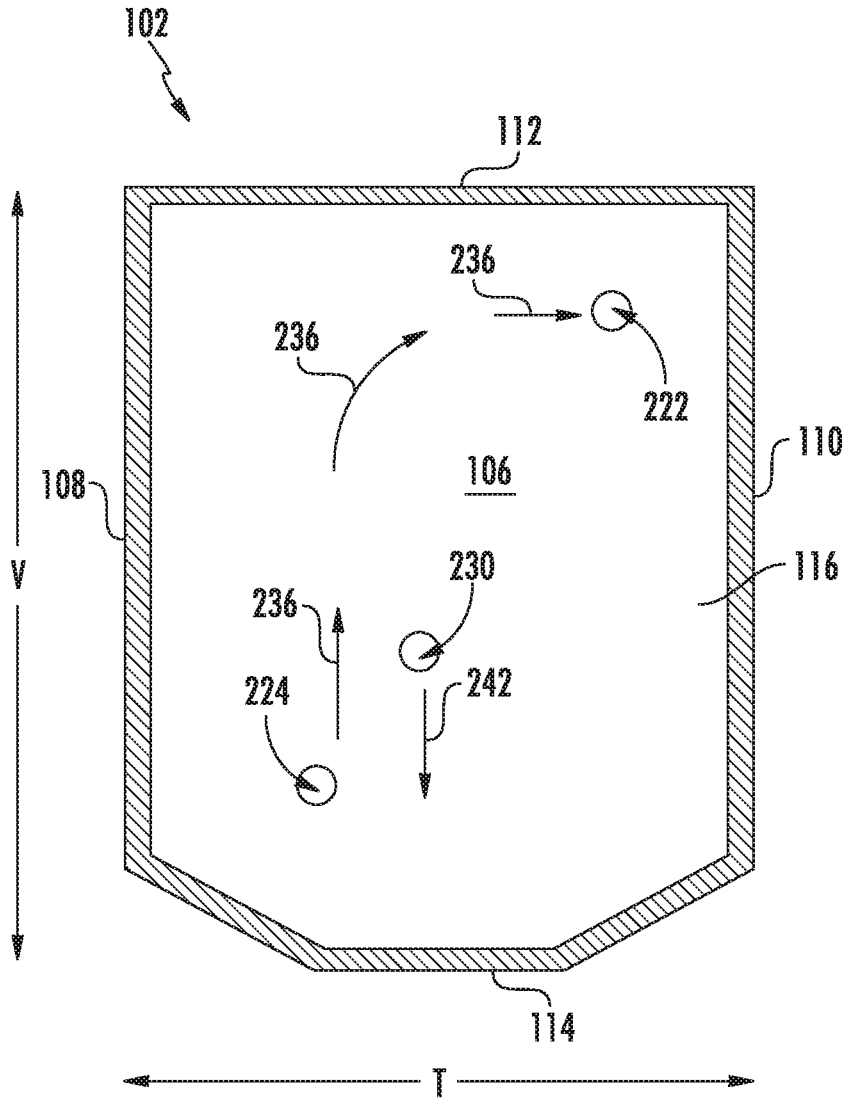
FIG. 3 provides a side cross-sectional view of a tub in accordance with embodiments of the present disclosure.
Figure 5:
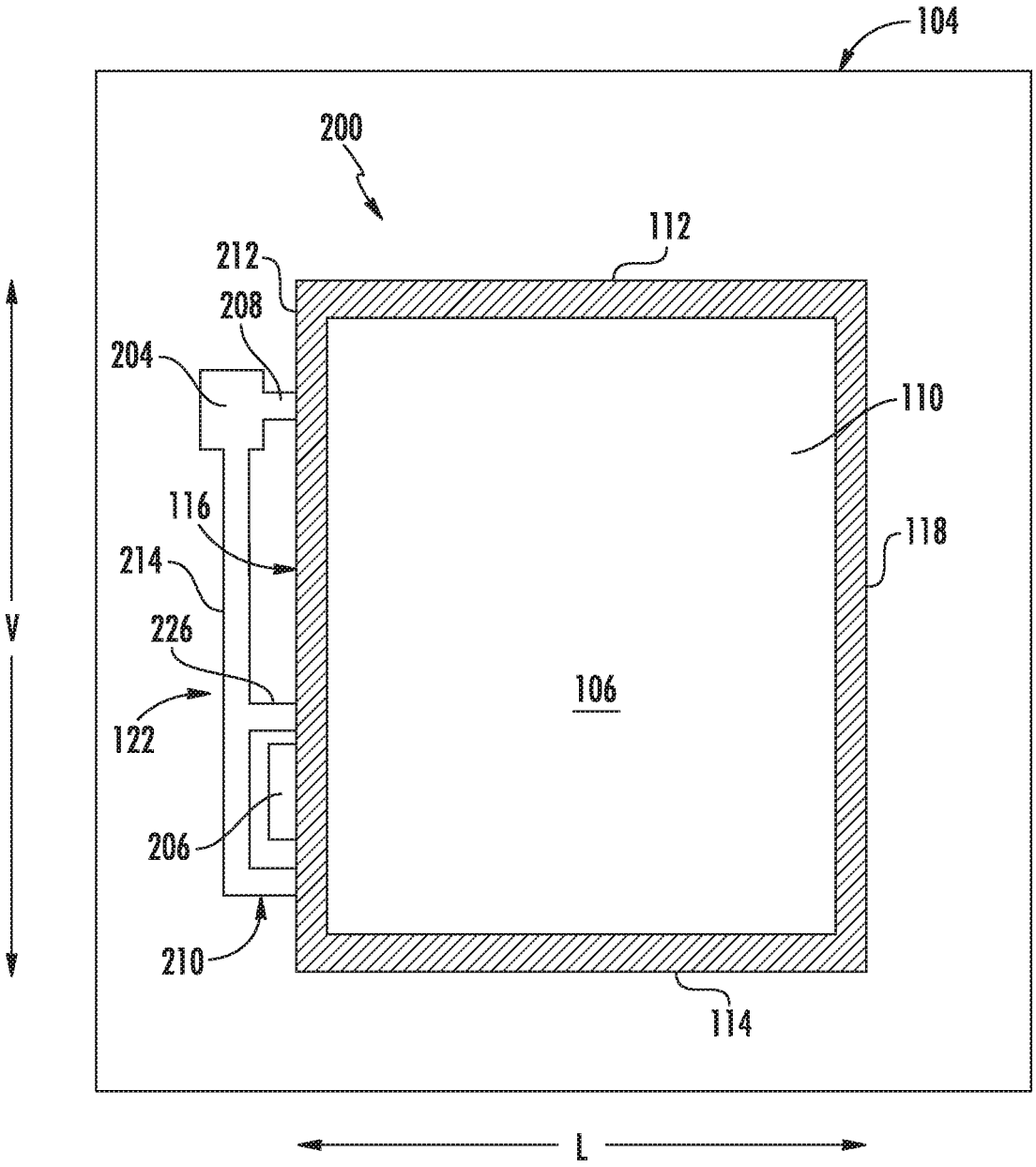
FIG. 5 provides a front cross-sectional view of an embodiment of a drying system in accordance with embodiments of the present disclosure.

The dishwasher appliance 100 includes a tub 102 positioned within a cabinet 104. The tub 102 defines a wash chamber 106 therein. As illustrated in FIGS. 3 and 5, the tub 102 includes a front wall 108, a rear wall 110, a top wall 112, a bottom wall 114, a first side wall 116, and a second side wall 118. The front wall 108 defines a front opening (not shown) therein that provides access to the wash chamber 106.

A bottom 120 of a door 122 pivotally couples to the cabinet 104. In this respect, the door 122 is moveable between a normally closed position shown in (FIGS. 1 and 2) and an open position. When the door 122 is in the closed position, the wash chamber 106 is sealed shut (i.e., fluidly isolated from ambient air) for dishwasher appliance operation. Conversely, articles may be removed or placed in the wash compartment 106 when the door is in the open position. A latch 124 may lock and unlock the door 122 to provide access to the wash chamber 106.

Upper and lower rack assemblies 126, 128 are slidably positioned within the wash chamber 106. More specifically, guide rails 130 mount to the first and second side walls 116, 118 of the tub 102. Rollers 134, 136 coupled to the rack assemblies 126, 128 engage the guide rails 130 thereby permitting the rack assemblies 126, 128 to move along the transverse direction T relative to the tub 102. In this respect, each rack assembly 126, 128 may move between an extended loading position (not shown) and a retracted position shown in FIGS. 1 and 2. When in the extended loading position, the rack assemblies 126, 128 are positioned at least partially outside of the wash chamber 106. Conversely, the rack assemblies 126, 128 are located inside the wash chamber 106 in the retracted position. Each rack assembly 126, 128 is generally formed as a lattice structure having a plurality of elongated members 138. For clarity of illustration, only some of the elongated members 138 forming the rack assemblies 126, 128 are shown in FIG. 2. The lower rack assembly 128 may also include a silverware basket (not shown) removably thereto for receiving silverware, utensils, and the like, which may otherwise be too small for receipt by the rack assemblies 126, 128.

The dishwasher appliance 100 also includes various spray-arm assemblies positioned with the wash chamber 106. More specifically, a lower spray-arm assembly 140 may be rotatably positioned within a lower region 142 of the wash chamber 106 and above a sump portion 144 of the tub 102. This positioning may permit the lower spray-arm assembly 140 to rotate in relatively close proximity to the lower rack assembly 128. A mid-level spray-arm assembly 146 may be positioned within an upper region 148 of the wash chamber 106. As such, the mid-level spray-arm assembly 146 may be positioned in close proximity to the upper rack assembly 126. Additionally, an upper spray-arm assembly 150 may be positioned above the upper rack assembly 126 along the vertical direction V.

A fluid circulation system 152 circulates water and dishwasher fluid within the wash chamber 106. In particular, the fluid circulation system 152 may include a pump 154 positioned in a machinery compartment 156 located below the sump portion 142 of the tub 104 along the vertical direction. The pump 154 supplies the water and dishwasher fluid from the sump portion 142 to the spray-arm assemblies 140, 146, 150. In this respect, each spray-arm assembly 140, 146, 150 includes an arrangement of discharge ports or orifices (not shown) that direct the water and dishwasher fluid onto the dishes or other articles placed in the rack assemblies 126, 128. The discharge ports are oriented such that the water and dishwasher fluid flowing therethrough causes the spray-arm assemblies 140, 146, 150 to rotate. The rotation of the spray-arm assemblies 140, 146, 150 distributes the water and dishwasher fluid exiting the discharge ports to substantially all of the dishes and other items placed in the rack assemblies 126, 128.

The dishwasher 100 further includes a controller 158 configured to regulate operation of the dishwasher 100. The controller 158 may include a memory and one or more microprocessors, such as one or more general or special purpose microprocessors. The one or more microprocessors may execute programming instructions or micro-control code associated with a cleaning cycle stored in the memory. The memory may be random access memory, such as DRAM, or read only memory, such as ROM or FLASH. Furthermore, the memory may be a separate component from the processor or may be included onboard within the processor.

The controller 158 may be positioned in a variety of locations throughout dishwasher 100. In the embodiment shown in FIGS. 1 and 2, the controller 158 is located within a control panel area 160 of the door 122. In such an embodiment, input/output ("I/O") signals may be transmitted between the controller 158 and various components of the dishwasher 100 along wiring harnesses (not shown) routed through the bottom 120 of the door 122.

The controller 158 may include a user interface 162 through which a user may select various operational features and modes and monitor progress of the dishwasher 100. In this respect, the user interface 162 may represent a general purpose I/O ("GPIO") device or functional block. In some embodiments, for example, the user interface 162 may include various electrical, mechanical or electro-mechanical input devices 164, such as one or more rotary dials, push buttons, and/or touch pads. The user interface 162 may also include one or more output devices, such as digital or analog display devices, which provide operational feedback to the user. Furthermore, the user interface 162 may be communicatively coupled to the controller 158 via one or more signal lines (not shown) or shared communication busses (not shown).

Figure 4:
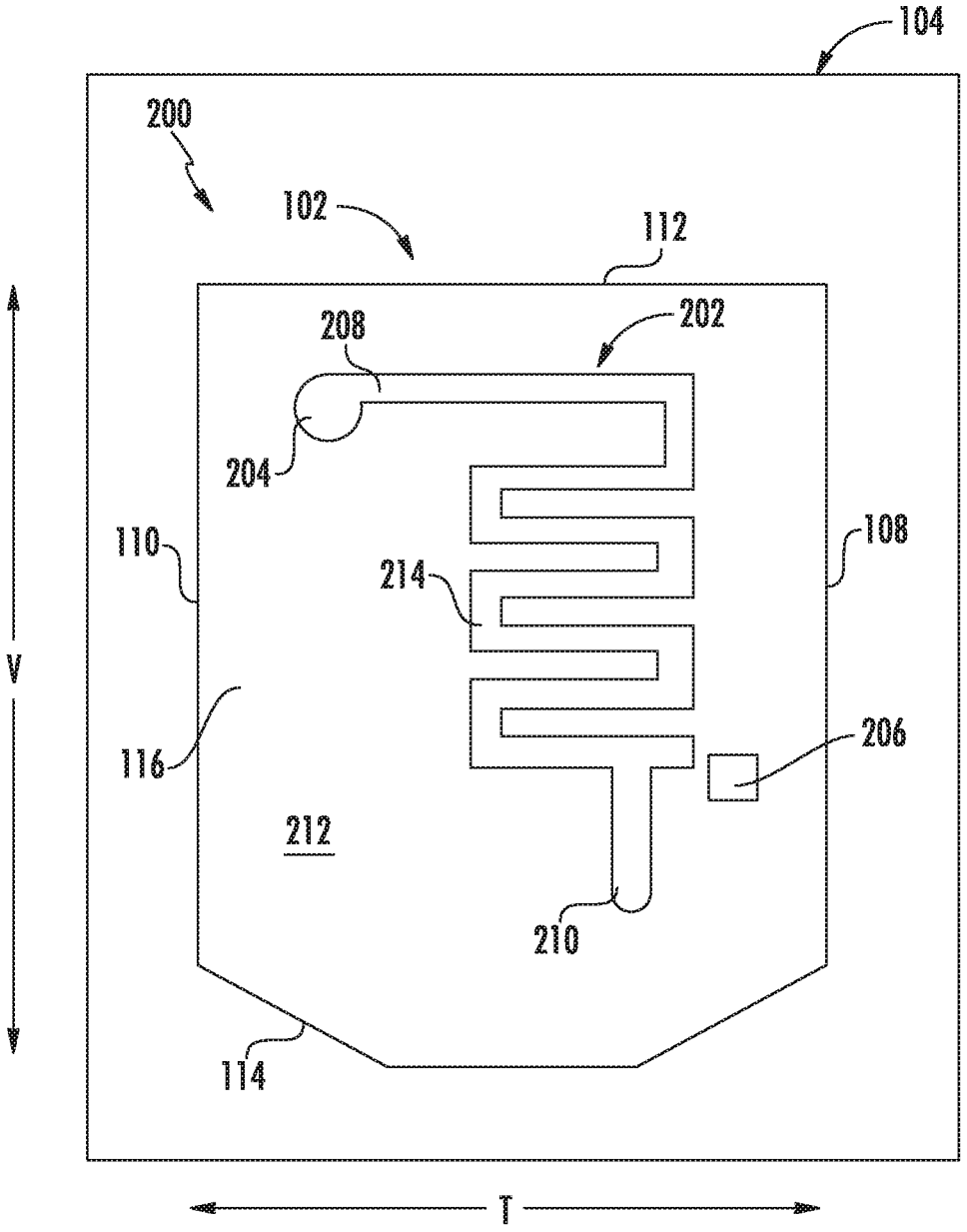
FIG. 4 provides a side view of an embodiment of a drying system in accordance with embodiments of the present disclosure.

Referring now to FIG. 4, the dishwasher appliance 100 includes a drying system 200. As shown, the drying system 200 generally includes a cooling conduit 202, a first fan 204, and a second fan 206. In particular, the first fan 204 is operable to draw wash chamber air from the wash chamber 106 through the cooling conduit 202. The second fan 206 is operable to direct a flow of ambient air onto the cooling conduit 202. In this respect, the flow of ambient air cools and dehumidifies the wash chamber air flowing through the cooling conduit 202. Once dehumidified, the cooling conduit 202 returns the wash chamber air to the wash chamber 106.

As illustrated in FIGS. 4 and 5, the cooling conduit 202 may be external to the tub 102. Further, the cooling conduit 202 may be coupled to the first side wall 116 of the tub 102. More specifically, the cooling conduit 202 may include a first end 208 and a second end 210 that each couple to an exterior surface 212 of the first side wall 116. In this respect, the cooling conduit 202 may be positioned between the first side wall 116 and the cabinet 104 (FIG. 2) along the lateral direction L. In some embodiments, portions of the cooling conduit 202, such as a serpentine portion 214, may be spaced apart from the first side wall 116 along the lateral direction L to facilitate greater exposure to the flow of ambient air. The cooling conduit 202 may also be coupled to the first side wall 116 at positions between the first and second ends 208, 210 along the vertical direction V. In alternate embodiments, the cooling conduit 202 may be coupled to the second side wall 118 or the rear wall 110 of the tub 102.

Figure 6:
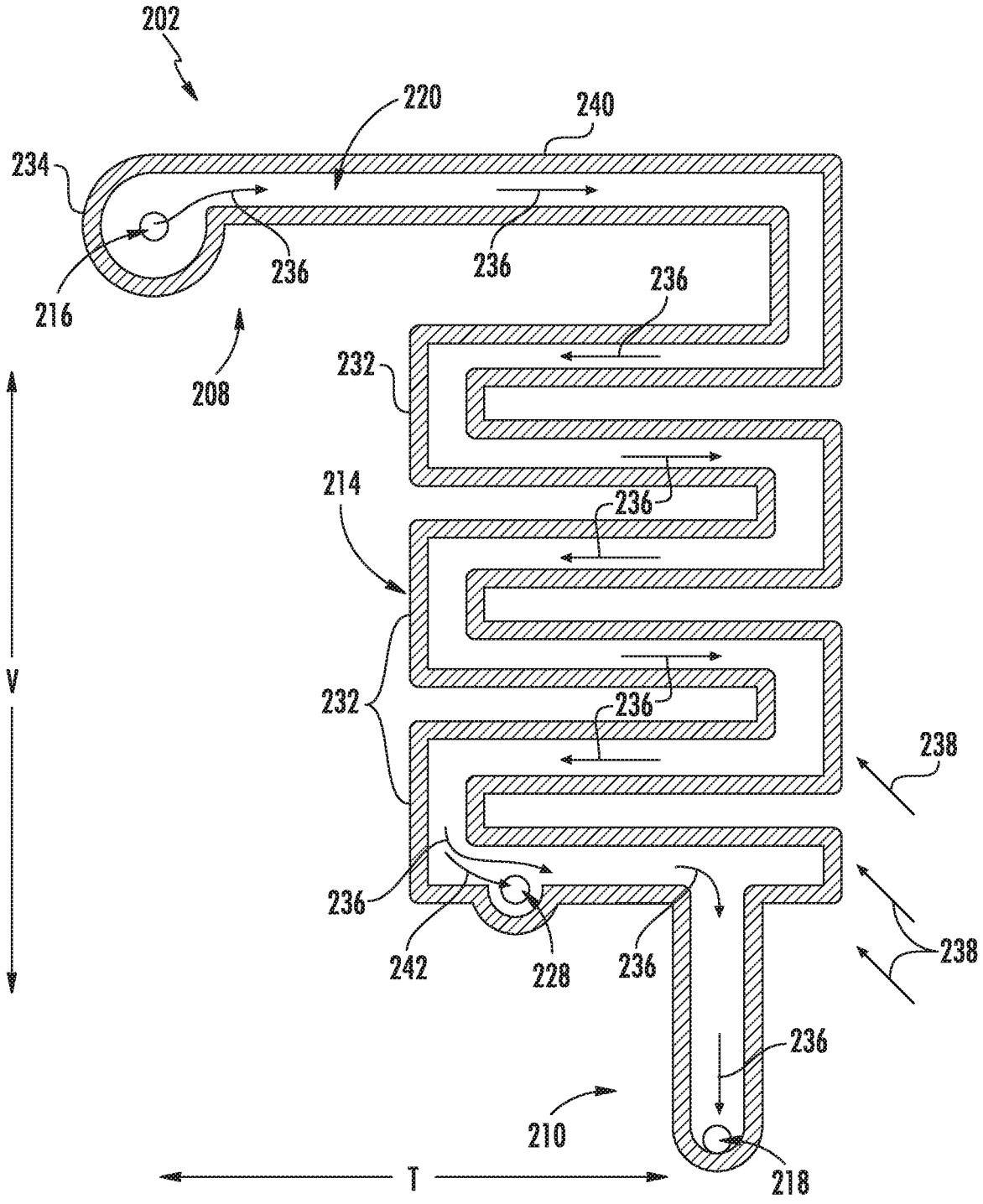
FIG. 6 provides a side cross-sectional view of an embodiment of a cooling conduit in accordance with embodiments of the present disclosure.

FIG. 6 illustrates the cooling conduit 202 in greater detail. As shown, the first end 208 of the cooling conduit 202 defines an inlet port 216. Similarly, the second end 210 defines an outlet port 218. The cooling conduit 202 also defines a cooling conduit passage 220 extending from the inlet port 216 to the outlet port 218. The inlet and outlet ports 216, 218 are respectively in fluid communication with a first aperture 222 (FIG. 3) and a second aperture 224 (FIG. 3) defined by the first side wall 116 of the tub 102. In this respect, the cooling conduit passage 220 is in fluid communication with the wash chamber 106.

The cooling conduit 202 may also include a condensate outlet portion 226 that defines a condensate port 228. More specifically, the condensate port 228 is in fluid communication with a third aperture 230 (FIG. 3) defined by the first side wall 116 of the tub 102. In this respect, the condensate port 228 and the third aperture 230 also provide fluid communication between the cooling conduit passage 220 and the wash chamber 106. As such, the condensate port 228 is operable to permit condensate within the cooling conduit passage 220 to flow into the wash chamber 106.

FIG. 6 illustrates the relative positioning between the inlet port 216, the outlet port 218, and the condensate port 228. More specifically, the inlet port 216 may be spaced apart from the outlet port 218 along the vertical direction V. In the embodiment shown, the inlet port 216 is positioned above the outlet port 218 along the vertical direction V. The condensate port 228 may be positioned between the inlet and outlet ports 216, 218 along the vertical direction V. In alternate embodiments, however, the cooling conduit 202 may define any suitable relative positioning between the inlet port 216, the outlet port 218, and the condensate port 228.

The cooling conduit 202 may have any suitable shape and/or configuration extending between the inlet port 216 and the outlet port 218. For example, as indicated above, the cooling conduit 202 may include a serpentine portion 214. In particular, the serpentine portion 214 may include one or more passes 232, which increase the length of the cooling conduit passage 220. This increased length facilitates greater cooling and dehumidification of the wash chamber air flowing through the cooling conduit passage 220. In the embodiment shown in FIG. 6, the serpentine portion 214 includes three passes 232. In alternate embodiments, however, the serpentine portion 214 may include more or fewer passes 232. In some embodiments, the cooling conduit 202 may not include the serpentine portion 214. Furthermore, the cooling conduit 202 may have an annular cross-sectional shape or any other suitable cross-sectional shape.

As mentioned above, the drying system 200 includes the first and second fans 204, 206. The first fan 204 may be positioned within the cooling conduit 202 at or proximate to the first end 208. In some embodiments, the first fan 204 may be integrated into the cooling conduit 202. In this respect, the cooling conduit 202 may include a first fan housing 234 in which the impeller or blades (not shown) of the fan may be positioned. As shown in FIGS. 4 and 5, the second fan 206 is external to the cooling conduit 202, and may be positioned between the tub 102 and the cabinet 104. More specifically, the second fan 206 may be coupled to the exterior surface 212 of the first side wall 116 of the tub 102. In alternate embodiments, however, the first and second fans 204, 206 may be positioned in any suitable locations within the dishwasher appliance 100. The first and second fans 204, 206 may be axial fans, centrifugal fans, mixed flow fans, cross flow fans, or any other suitable type of fans. Furthermore, the first and second fans 204, 206 may the same type of fans or different types of fans.

In operation, the drying system 200 cools and dehumidifies wash chamber air indicated by arrow 236. Referring now to FIGS. 3, 5, and 6, the first fan 204 pumps the wash chamber air 236 from the wash chamber 106 through the outlet port 222 in the tub 102 and into the inlet port 216. The first fan 204 then draws the wash chamber air 236 through the cooling conduit passage 220 to the outlet port 218. The second fan 206 directs a flow of ambient air indicated by arrows 238 onto an exterior surface of the cooling conduit 202. As the wash chamber air 236 flows through the cooling conduit passage 220, the flow of ambient air 238 cools the wash chamber air 236. In particular, the ambient air 238 may cool the wash chamber air 236 to a temperature below the condensation point thereof. In this respect, the water present in the wash chamber air 236 may condense within the cooling conduit passage 220, thereby dehumidifying the wash chamber air 236. Condensate indicated by arrows 242 may flow within the cooling conduit passage 220. Further, the condensate may exit the cooling conduit passage 220 through the condensate port 228, and may immediately flow into the wash chamber 106 through the third aperture 230. Once inside the wash chamber 106, the condensate may flow to or towards the sump portion 144. The dehumidified wash chamber air 236 then exits the cooling conduit passage 220 through the outlet port 218, and immediately enters the wash chamber 106 through the second aperture 224 defined by the tub 102. The dehumidified wash chamber air 236 may flow upward along the vertical direction V past the dishes and other items placed in the rack assemblies 126, 128. As such, the dehumidified wash chamber air 236 may absorb water present on the dishes and other items, thereby drying the dishes and other items. The now humid wash chamber air 236 then flows through the cooling conduit passage 220 for dehumidification.

The drying system 200 described above operates in a closed loop manner. In this respect, the wash chamber air 136 flows from the wash chamber 106 through the cooling conduit passage 220 and back to the wash chamber 106. As such, the cooling conduit passage 220 is fluidly isolated from the ambient air 238 during operation of the dishwasher appliance 100 (i.e., when the door 122 is closed, vertical position shown in FIGS. 1 and 2). That is, the wash chamber air 136 does not mix or otherwise come into contact with the ambient air 238 when the door 122 is in the closed, vertical position.

Figure 7:
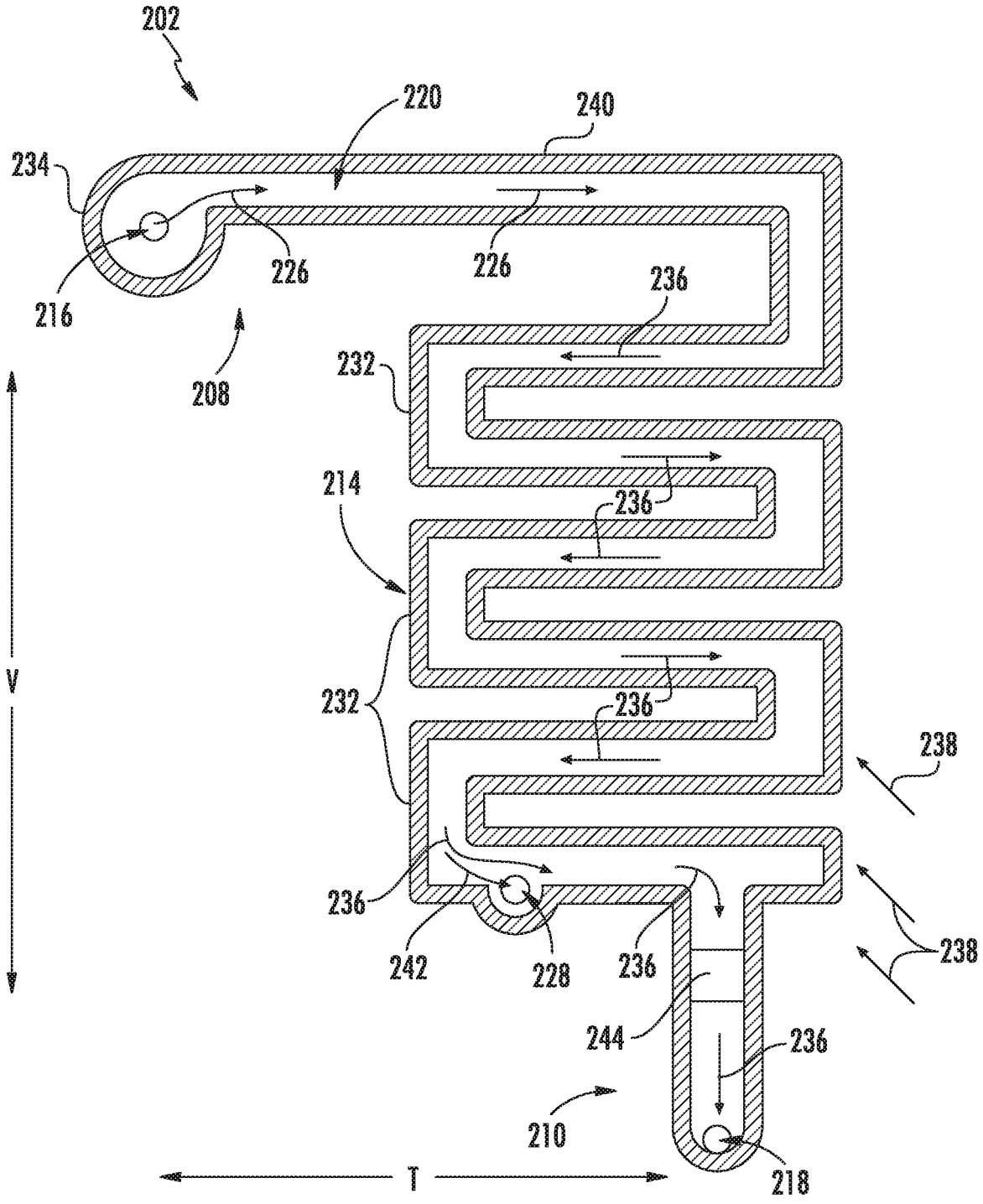
FIG. 7 provides a side cross-sectional view of an alternate embodiment of a drying system in accordance with embodiments of the present disclosure.

Referring now to FIG. 7, the drying system 200 may optionally include a heater 244 operable to heat the wash chamber air 236 flowing through the cooling conduit passage 220. In particular, the heater 244 is positioned within the cooling conduit passage 220. More specifically, the heater 244 may be positioned between the condensate port 228 and the outlet port 218 along the vertical direction V. In this respect, the heater 244 may heat the cooled and dehumidified wash chamber air 236 before it exits the cooling conduit passage 220. Heating the wash chamber air 236 before it enters the wash chamber 106 permits the wash chamber air 236 to absorb more water from the dishes and other items in placed in the rack assemblies 126, 128, thereby improving the drying thereof. In alternative embodiments, the heater 244 may be positioned circumferentially around the cooling conduit 202. It should be appreciated that the heater 244 may be a resistance heater or any other suitable type of heater.

Figure 8:
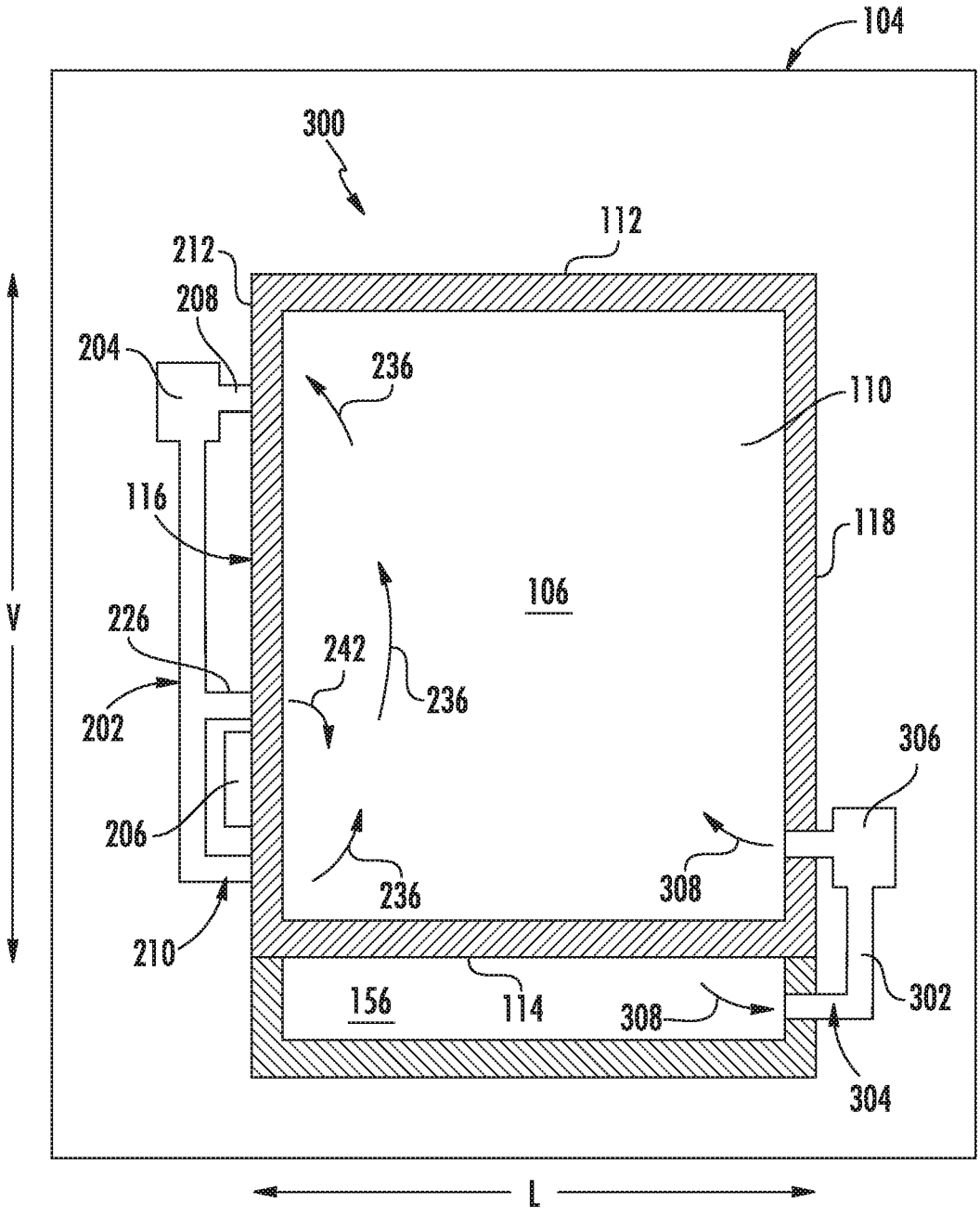
FIG. 8 provides a front cross-sectional view of a further embodiment of a drying system in accordance with embodiments of the present disclosure.

FIG. 8 illustrates an alternate embodiment of the drying system 300 for the dishwasher appliance 100. As shown, the drying system 300 generally includes the cooling conduit 202, the first fan 204, and the second fan 206 of the drying system 200. Furthermore, the cooling conduit 202, the first fan 204, and the second fan 206 operate in substantially the same manner in the drying system 300 as in the drying system 200.

The drying system 300 also includes a heating conduit 302 that supplies machinery compartment air from the machinery compartment 156 to the wash chamber 106. More specifically, the heating conduit 302 extends from the machinery compartment 156 to the second side wall 118 of the tub 102. In this respect, the heating conduit 302 may couple to the second side wall 118 and the cooling conduit 202 may couple to the first side wall 116. As such, the heating conduit 302 defines a heating conduit passage 304 therethrough that fluidly couples the machinery compartment 156 and the wash chamber 106. In alternate embodiments, the heating conduit 302 may couple to the first side wall 116 or the rear wall 110.

The drying system 300 may also include a third fan 306 operable to pump machinery compartment air indicated by arrows 308 through the heating conduit passage 302. In particular, the third fan 306 pumps machinery compartment air 308 from the machinery compartment 156 to the wash chamber 106. The machinery compartment air 308 is typically hotter than the ambient air 238 during operation of the dishwasher appliance 100 due to proximity to the pump 154 and other heat-producing components of the dishwasher appliance 100. The hot machinery compartment air 308 increases the temperature of the wash chamber air 236 within the wash chamber 106. This heating permits the wash chamber air 236 to absorb more water from the dishes and other items in placed in the rack assemblies 126, 128, thereby improving the drying thereof. The third fan 306 may be integrated into the heating conduit 302. In alternate embodiments, however, the third fan 306 may be positioned in any suitable location within the dishwasher appliance 100. The third fan 306 may be an axial fan, a centrifugal fan, a mixed flow fan, a cross flow fan, or any other suitable type of fan.

As discussed in greater detail above, the drying systems 200, 300 circulate the wash chamber air 236 through the cooling conduit passage 220. The second fan 206 provides the flow of ambient air 238 to the exterior surface 240 of the cooling conduit 202, thereby cooling the wash chamber air 236. This cooling causes the water in the wash chamber air 236 to condense in the cooling conduit passage 220. The dehumidified wash chamber air 236 returns the wash chamber 106. In this respect, and unlike certain conventional drying systems, the humid wash chamber air 236 is not exhausted into the ambient air 238. Accordingly, the drying systems 200, 300 do not produce condensation on the floor or other nearby surfaces. Furthermore, with respect to the drying system 200, the wash chamber air 236 is fluidly isolated from the ambient air 238 during operation of the dishwasher appliance 100. As such, the drying system 200 provides a quicker drying time than conventional drying systems that mix ambient air and wash chamber air.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a lateral direction, a transverse direction and a vertical direction, the dishwasher appliance comprising:

a cabinet;

a tub positioned within the cabinet, the tub extending between a front wall and a rear wall along the transverse direction, a first side wall and a second side wall along the lateral direction, and a top wall and a bottom wall along the vertical direction, the tub defining a wash chamber;

a door pivotally coupled to the cabinet such that the door is movable between an open position and a closed position to permit selective access to the wash chamber via an opening defined by the front wall of the tub; and a drying system comprising:

a cooling conduit coupled to the first side wall of the tub, the cooling conduit defining an inlet port, an outlet port, and a cooling conduit passage extending between the inlet port and the outlet port, the inlet port and the outlet port spaced apart from one another along the vertical direction, the cooling conduit further defining a condensate port in fluid communication with the wash chamber, the condensate port positioned between the inlet port and the outlet port along the vertical direction;

a heating conduit coupled to the second side wall of the tub, the heating conduit extending from the second side wall of the tub to a machinery compartment positioned below a sump portion of the tub along the vertical direction, the heating conduit defining a heating conduit passage providing fluid communication between the machinery compartment and the wash chamber;

a first fan positioned within the cooling conduit, the first fan operable to draw wash chamber air into the cooling conduit passage;

a second fan operable to direct a flow of ambient air onto an exterior surface of the cooling conduit, wherein the second fan is positioned between the condensate port and the outlet port along the vertical direction;

a third fan operable to draw machinery compartment air through the heating conduit passage and into the wash chamber; and a heater positioned within the cooling conduit passage.

2. The dishwasher appliance of claim 1, wherein the wash chamber air within the cooling conduit passage is fluidly isolated from the flow of ambient air during operation of the dishwasher appliance.

3. The dishwasher appliance of claim 1, wherein the heater is positioned between the outlet port and the condensate port along the vertical direction.

4. The dishwasher appliance of claim 1, wherein the cooling conduit comprises a serpentine portion having a plurality of passes.

5. The dishwasher appliance of claim 4, wherein the serpentine portion is spaced apart from the first side wall along the lateral direction.

6. The dishwasher appliance of claim 1, wherein the cooling conduit is external to the tub such that the cooling conduit is positioned between the cabinet and the tub along the lateral direction.

7. The dishwasher appliance of claim 1, wherein the second fan is coupled to an exterior surface of the first side wall of the tub.

8. The dishwasher appliance of claim 1, wherein the cooling conduit is coupled to the second side wall or the rear wall of the tub.

9. The dishwasher appliance of claim 1, wherein the heating conduit is coupled to the first side wall or the rear wall.

10. The dishwasher appliance of claim 1, wherein the third fan is integrated into the heating conduit.

* * * * *